US007284684B1

(12) United States Patent
Gharavi

(10) Patent No.: US 7,284,684 B1
(45) Date of Patent: Oct. 23, 2007

(54) DEVICE TO FACILITATE PUTTING ON A BRACELET AND METHOD

(76) Inventor: Rad Gharavi, 5323 S. Drexel Ave., Chicago, IL (US) 60615

( * ) Notice: Subject to any disclaimer, the term of this patent is extended or adjusted under 35 U.S.C. 154(b) by 207 days.

(21) Appl. No.: 11/241,367

(22) Filed: Oct. 3, 2005

(51) Int. Cl.
*A47G 25/90* (2006.01)

(52) U.S. Cl. ..... 223/111

(58) Field of Classification Search ..... 223/111, 223/DIG. 2, 1; 211/13.1, 85.2; 206/6.1, 206/566

See application file for complete search history.

(56) References Cited

U.S. PATENT DOCUMENTS

| | | | | |
|---|---|---|---|---|
| 2,896,890 | A | 7/1959 | Hlavac | |
| 2,926,875 | A | 3/1960 | Hoye | |
| 3,016,589 | A * | 1/1962 | Collins | 24/3.2 |
| 4,650,141 | A | 3/1987 | Longo et al. | |
| 4,779,312 | A | 10/1988 | Carlson | |
| D323,132 | S | 1/1992 | Grenna | |
| 5,405,066 | A | 4/1995 | Fakier | |
| 5,709,327 | A * | 1/1998 | LaMacchia et al. | 223/111 |
| 5,741,035 | A | 4/1998 | Glass | |
| 5,785,217 | A | 7/1998 | Gorham, Jr. | |
| 5,899,369 | A | 5/1999 | Macripo | |
| 5,934,526 | A | 8/1999 | Rosenbaum et al. | |
| 6,036,065 | A | 3/2000 | Wofford et al. | |
| 6,095,346 | A * | 8/2000 | Idelberger | 211/85.2 |
| 6,484,910 | B1 * | 11/2002 | Korkos | 223/111 |
| 6,854,625 | B2 | 2/2005 | Tedeschi | |

* cited by examiner

*Primary Examiner*—Danny Worrell
(74) *Attorney, Agent, or Firm*—Law Office of Joan I. Norek; Joan I. Norek

(57) ABSTRACT

A bracelet attachment assistance device has a frame member, a clamp member and a slider arm. The clamp member has a connection segment coupled to the frame member, a first jaw member, a second jaw member movable between an opened-clamp position and a closed-clamp position, and a clamping region along the first and second jaw members. The slider arm member is seated on the frame member, and has a biased distal end, and is movable between a closed position whereat the distal end is positioned adjacent the clamping region of the clamp member and an opened position whereat the distal end is positioned spaced apart from the clamping region of the clamp member. This bracelet assistant is used by gripping the spring ring of the bracelet between the thumb and the finger of either the target hand or the non-target hand with the tab of the spring ring, and then inserting the distal end of the spring ring into the clamp and positioning the spring ring with the tab close to or abutting the forward side of the slider arm. Next, the slider arm is raised sufficiently to hook the tab of the spring ring, and then is released to bear against the tab of the spring ring, to open the spring ring and continue to hold it open. Therefore the wrist of the target hand can be positioned below the clamp, and the other hand is free to draw the bracelet around and place the jump ring into the open spring ring. There is no manual holding-open of the spring ring during this last step.

17 Claims, 4 Drawing Sheets

DEVICE TO FACILITATE PUTTING ON A BRACELET AND METHOD

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates to devices and methods for facilitating putting a bracelet on a wrist. In particular, the present invention relates to devices and methods that assist someone putting on a bracelet which has a clasp closure. More particularly, the present invention relates to devices and methods for putting on a bracelet without someone else's assistance.

Putting a clasp-closure bracelet on one's own wrist, and securing the clasp, can be difficult simply because a person normally needs to balance the bracelet on the back of the wrist during the process. The typical series of movements is placing the bracelet across the wrist with its free ends dangling downwards, then grasping the dangling spring ring of the clasp with the thumb and fore-finger, then opening the spring ring by pulling its tab back with the thumb's finger nail while the clasp is held about its outer circumference between the thumb and the fore-finger, then catching the jump ring dangling at the other end of the bracelet in the open mouth of the spring ring without releasing the tab until the jump ring is caught, and then releasing the tab of the spring ring, permitting it to slide back to its normally closed position.

Such a procedure for putting on a clasp-closure bracelet is typically not only awkward but frustrating because the required grip on the spring ring is so easily lost when a person is trying to catch the jump ring. It is far easier to join the two ends of a bracelet using two hands, namely one hand to hold the spring ring open and the other hand to place the jump ring into the open mouth of the spring ring. This is how one person would fasten a bracelet on the wrist of another person. Obviously a person fastening a bracelet to their own wrist cannot handle the clasp in that manner because the hand just above or past the wrist cannot reach back to a bracelet balanced on the wrist. In other words, when a bracelet is balanced on a wrist, only the other hand is free to handle it. Such a bracelet is of course routinely one that, when closed, is too small to slide over the hand. (Bracelets of larger circumferences, or of sufficient elasticity to be stretched to a larger circumference, can of course be fastened using both hands, and after fastening they can be slid over the hand onto the wrist. Such bracelets, however, do not require, and typically do not have, clasp closures in the first instance.)

Heretofore there have been many devices developed to alleviate the problems encountered in putting on a bracelet, including the devices described in: U.S. Pat. No. 6,854,625 which issued on Feb. 15, 2005 to Tedeschi; U.S. Pat. No. 6,036,065 which issued on Mar. 14, 2000 to Wofford et al.; U.S. Pat. No. 5,934,526 which issued on Aug. 10, 1999 to Rosenbaum et al.; U.S. Pat. No. 5,709,327 which issued Jan. 20, 1998 to LaMacchia et al.; U.S. Pat. No. 5,405,066 which issued Apr. 11, 1995 to Fakier; U.S. Pat. No. 4,779,312 which issued on Oct. 25, 1988 to Carlson; and U.S. Pat. No. 2,926,875 which issued on Mar. 1, 1960 to Hoye. Nonetheless the need for a down-to-earth, yet effective, device in the marketplace continues.

BRIEF SUMMARY OF THE INVENTION

The present invention provides a bracelet attachment assistance device for attaching a clasp-closure type bracelet to one's own wrist which includes a free-standing combination of a clamp or clip which grasps or holds the spring ring of the clasp and a slider arm with a biased tip which, when released, meets the clamp or clip at about a 60 degree angle and bears against or hooks the tab of the spring ring, drawing it back and thus opening the spring ring and holding the spring ring in the open position. The user then merely places a wrist proximate the dangling bracelet and with the opposite hand draws the jump ring end around the wrist and inserts the jump ring into the open mouth of the spring ring.

DETAILED DESCRIPTION OF THE INVENTION

Figure 1:
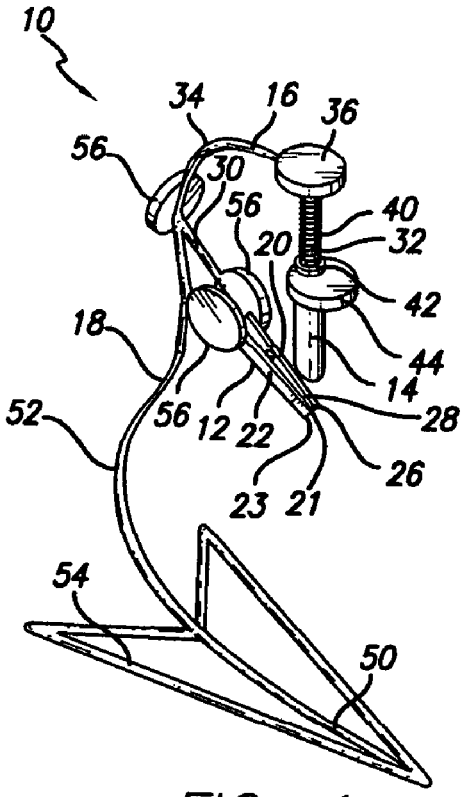
FIG. 1 is a perspective view of a bracelet attachment assistance device of the present invention in an open position.

Referring now to the invention in more detail, in FIG. 1 to FIG. 4 there is shown a bracelet adjutant or assistant of the present invention, designated generally by the reference numeral 10. The adjutant 10, in the embodiment shown and in preferred embodiment, is comprised of a stand 18, a clamp 12, a slider arm 14, and a frame or framework 16 that positions the clamp 12 and slider arm 14 to meet proximate their respective distal ends at an angle of from about 50 to about 70 degrees, which includes a 60 degree angle as shown.

The clamp 12 has a first clamp member 20 and an opposed second clamp member 22. As shown and in preferred embodiment, the first clamp member 20 is a fixed clamping member, or in other words the first clamp member 20 is fixed or immobile relative the framework 16. The second clamp member 22 is to a degree movable or mobile relative the first clamp member 20 and the framework 16 in that it turns about a pivot point from a normal closed, clamped or converged position in which the first clamp member 20 and the second clamp member 22 meet or clamp about something at or about their distal ends, to an open or unclamped position in which the distal end 21 of the first clamp member 20 and the distal end 23 of the second clamp member 22 are spaced apart. It is of course to be understood that when the clamp 12 is not clamped about something, the distal end 21 of the first clamp member 20 and the distal end 23 of the second clamp member 22 will meet, and when they are clamped about something, the distal end 21 of the first clamp member 20 and the distal end 23 of the second clamp member 22 will not meet but instead each will bear against the object that is clamped between them.

As shown and in preferred embodiment, the clamp 12 is an alligator clip 12. An alligator clip is also known as a crocodile clip or a bulldog clip, and has a construction similar to a clothespin. In more detail, the first clamp member 20 of the alligator clip 12 can be, and is herein at times, called the first jaw 20 and the second clamp member 22 of the alligator clip 12 can be, and is herein at times, called the second jaw 22. This alligator clip 12 is a conventional alligator clip. It is a metal, spring-loaded clip with slightly tapering jaws (first jaw 20 and second jaw 22) normally in the closed position. In other words, the first jaw 20 and the second jaw 22 are forced together by a spring 24 mounted on a pin (not shown) that bridges the first jaw 20 and the second jaw 23 about mid-way back from their distal ends. The spring 24 closes the first jaw 20 and second jaw 22, and keeps them closed until the opposite or proximal end of the second jaw 22 is pressed, opening the first jaw 20 and second jaw 22. Upon release of the second jaw 22, the first jaw 20 and second jaw 22 will snap back into the closed position.

Alligator or crocodile clips are well known, conventional light-duty clamps that are used to make temporary electrical connections in the electronics and other fields. They are also used in dental offices or by barbers to attach protective covers over customers clothes, and in other fields where a secure, readily attached and detached, clip is convenient. (Larger versions of these clips, made of bare copper, are used as car jumper cables.)

Figure 3:
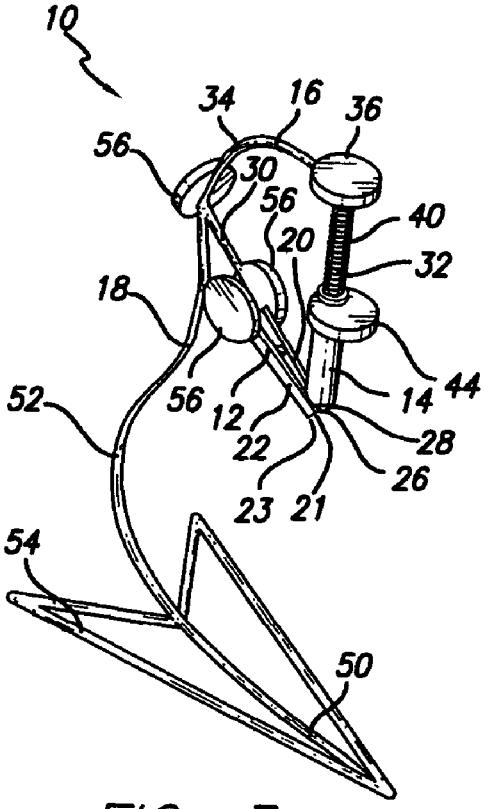
FIG. 3 is a perspective view of a bracelet attachment assistance device of FIG. 1 in the closed position.

As shown and in preferred embodiment, the inner tips of the alligator clip 12 are padded or cushioned, such as with a felt or rubber lining on at least the inner tip surfaces. This padding is shown as the felt liner 26 of the first jaw 20 and the felt liner 28 of the second jaw 22 as seen in FIG. 1 and FIG. 3. A suitable alligator clip for use as the clip 12 might have partial serrated teeth or instead a smooth tip.

The first clamp member 20 is coupled or joined to the framework 16 as mentioned generally above. The framework 16 as shown and in preferred embodiment includes at least three members, namely a first frame member 30, a second frame member 32 and a third frame member 34 bridging the first frame member 30 and second frame member 32. The first frame member 30 as shown is in alignment with, and is substantially coaxial with, the first jaw 20 of the alligator clip 12, although there are other configurations and conformations that are believed to be viable and workable. The alligator clip 12 as shown and in preferred embodiment is an alligator clip of the type sometimes called "with barrel" which indicates that the longer, bottom or fixed jaw includes a integral hollow tube opening at the rear end, opposite the clamping tip. (This tube or "barrel" receives an end of an electrical lead or wire when used for making electrical connections, which use of an alligator clip obviously is not related to the present invention. Instead, this type of clip is convenient for the present invention and is commercially available.) The alligator clip 12 of the present invention has a barrel or tube 29. The alligator clip 12 is fitted onto the first frame member 30 at the tube 29, or in other words, the end of the first frame member 30 is snugly received by the tube 29 and this coupling or joint is then soldered, welded or otherwise crimped or glued together with a strong adhesive to avoid any slippage of the tube 29 along the first frame member 30, or any wobbling of the alligator clip 12 relative the first frame member 30.

The second frame member 32 lies in substantially the same plane as the first frame member 30 and lies along a line that, if extended would meet the alligator clip 12 at about a 60 degree angle near, but slightly inward from, the tip of the alligator clip 12. Again, the slider arm 14 and the clamp 12 should meet at an angle of from about 50 to about 70 degrees, which includes a 60 degree angle as shown. Bridging the second frame member 32 and first frame member 30 is the third frame member 34. In more detail, both the first frame member 30 and second frame member 32 in the embodiment shown are straight tubular rods. The third frame member 34 is joined at its opposite ends to the proximal ends of the first frame member 30 and third frame member 34, and from the points of such junctions or joints the first frame member 30 and second frame member 32 converge towards each other. As noted above and elsewhere, the first frame member 30 and second frame member 32, if the second frame member 32 were extended, would meet at an angle of from about 50 to about 70 degrees, which includes a 60 degree angle as shown. The simplest, and possibly strongest, joint or junction of the third frame member 34 to respectively the first frame member 30 and second frame member 32 are right angle joints, and thus the third frame member 34 is curved or arcs between these joint or junction points. The third frame member 34 could of course instead be formed with one or more bends, but it is believed that a curved third frame member 34 facilitates the use of the adjutant 10 of the present invention, as illustrated in more detail below.

Figure 2:
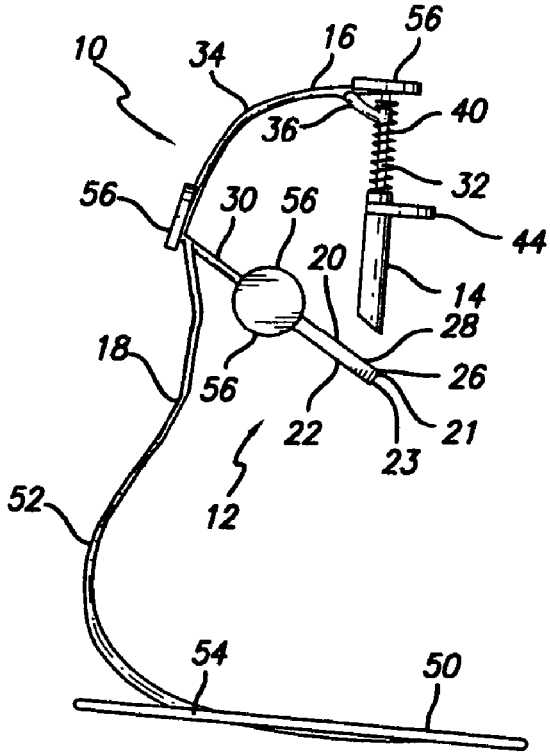
FIG. 2 is a side view of the bracelet attachment assistance device of FIG. 1 in an open position.
Figure 4:
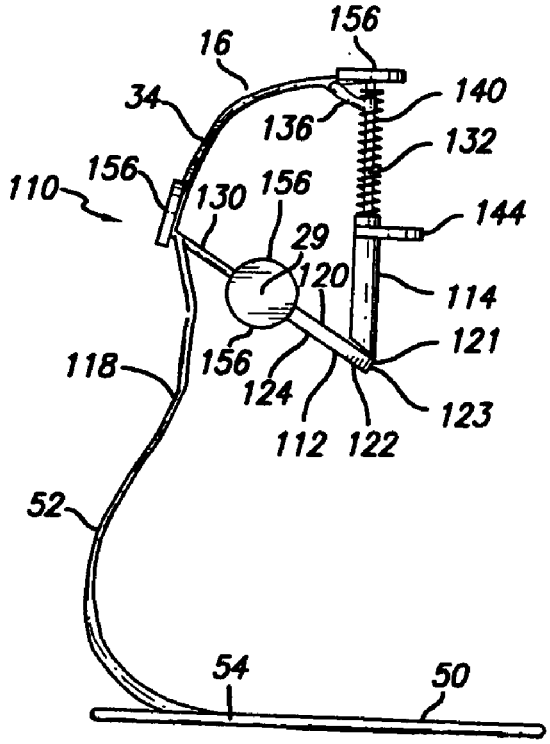
FIG. 4 is a side view of the bracelet attachment assistance device of FIG. 1 in the closed position.

The members of the framework 16 are sufficiently rigid tubular rods. The degree of rigidity required is that necessary to maintain the angle alignment between the first frame member 30 and the second frame member 32 under conditions of normal use of the adjutant 10. As shown in FIG. 2 and FIG. 4, a fourth frame member 36 can be included in the framework 16. Such a fourth frame member 36 runs between the second frame member 32 and a point on the third frame member 34 close to its connection to the second frame member 32, and acts as a cross-brace resisting any undue spreading apart, or crunching in, of the spatial disposition of the first frame member 30 and second frame member 32. Such an optional cross brace could of course run between any two of the three frame members 30, 32, 34 provided it does not interfere with the spring mounted on the second frame member 32, which spring is discussed below.

The slider arm 14 is a hollow tubular member which is slidably seated or journaled on the second frame member 32 below a spiral spring 40. The proximal-end first rim 42 of the slider arm 14 bears against the lower end of the spiral spring 40, while the upper end of the spiral spring 40 bears against the third frame member 34 about the point of the joint between the third frame member 34 and the second frame member 32. The spiral spring 40 is sized and coiled sufficiently to render the slider arm 14 spring-loaded, whereby the slider arm 14 is normally urged downward along the second frame member 32. The slider arm 14 has a jutting collar or tube 29 providing a finger hold for pushing the slider arm 14 upward along the second frame member 32 against the bias of the spiral spring 40. The slider arm 14 thus rides up the second frame member 32 against the spring bias when pushed back, and down the second frame member 32 when released. The slider arm 14 upon release meets, at its tip, the clamp 12 at a position just inward from the tip of the clamp 12, and therefore under normal use conditions the slider arm 14 cannot ride so far down the second frame member 32 that it can slide off the second frame member 32.

The tip of the slider arm 14 is cut back on a 120 degree angle so that the tip itself presents a 60 degree angle, and the distal-end second rim 46 of the slider arm 14 substantially meets the clamp 12, presenting a second rim-bounded orifice at or near the interface of the first jaw 20 and second jaw 22 of the alligator clip 12.

The framework 16 is supported in an elevated position by the stand 18. The stand 18 includes a foot 50 and a stem 52. As shown and in preferred embodiment the foot 50 is formed of two opposed, mirror-image, coplanar wings 54 bisected and joined to the stem 52 which extends beyond the wings 54 in the same plane, and opposite such extension rises up and curves somewhat inward. At its upper end the stem 52 is joined to the second frame member 32 and third frame member 34 at the junction of the second frame member 32 and third frame member 34. As shown and in preferred embodiment the stand 18 supports the framework 16 in such a position that the alligator clip 12 points downward at an angle of about 60 degrees off vertical.

The adjutant 10 also optionally includes one or more flat finger buttons or finger holds 56, namely on opposite sides of the alligator clip 12, at the connection between the first frame member 30 and third frame member 34, and/or at the connection between the second frame member 32 and third frame member 34. These finger holds 56 facilitate the operation of the adjutant 10, but are optional and not necessary to the operation of the adjutant 10. These finger holds 56 can be glued or soldered at the mounting points or mounted using conventional mechanical fasteners.

The use of the adjutant 10 of the present invention to assist putting a bracelet on one's own wrist is illustrated in FIG. 5*a* through FIG. 5*g*, which show a similar embodiment of the bracelet adjutant or assistant of the present invention, designated generally by the reference numeral 110. The adjutant 110, in the embodiment shown and in preferred embodiment, is comprised of a stand 118 (the base portion of which is not shown, and which can be the same as that shown in FIG. 1 to FIG. 4 or different), a clamp 112, a slider arm 114, and a frame or framework 116 that positions the clamp 112 and slider arm 114 to meet near or proximate their respective distal ends at about a 60 degree angle.

The clamp 112 has a first clamp member 120 and an opposed second clamp member 122 which are essentially the same as the first and second clamp members 20, 22 shown in FIG. 1 through FIG. 4 above, and therefore the descriptions of these components will not be fully repeated here. The first clamp member 120 is the fixed clamping member and the second clamp member 122 turns about a pivot point from a closed or clamped position to an open position in which the distal ends of the first and second clamp members 120, 122 are spaced apart. It is of course to be understood that when the clamp 112 is clamped about something, the distal end 121 of the first clamp member 120 and the distal end 123 of the second clamp member 122 will not meet but instead each will bear against the object that is clamped between them. The clamp 112 is a spring clip 112, such as an alligator clip as discussed in detail above regarding the embodiment shown in FIG. 1 to FIG. 4. It is a spring-loaded clip with slightly tapering jaws (first jaw 120 and second jaw 122) normally in the closed position. In other words, the first jaw 120 and the second jaw 122 are forced together by a spring mounted on a pin (not shown) that bridges the first jaw 120 and the second jaw 123 about mid-way back from their distal ends. The spring 124 closes the first jaw 120 and second jaw 122, and keeps them closed until the opposite or proximal end of the second jaw 122 is pressed, opening the first jaw 120 and second jaw 122. Upon release of the second jaw 122, the first jaw 120 and second jaw 122 will snap back into the closed position. Spring clips are well known commercially-available light-duty clamps.

The second clamp member 122 is coupled or joined to the framework 116 as mentioned generally above. The framework 116 as shown and in preferred embodiment includes three members, namely a first frame member 130, a second frame member 132 and a third frame member 134 bridging the first frame member 130 and second frame member 132. The first frame member 130 is in alignment with, and is substantially coaxial with, the first jaw 120 of the spring clip 112. The spring clip 112 as shown and in preferred embodiment is an spring clip of the type with an integral hollow tube (not shown in detail) opening at the rear end, opposite the clamping tip, and the spring clip 112 is fitted onto the first frame member 130 at the tube, or in other words, the end of the first frame member 130 is snugly received by the tube and this coupling or joint is then soldered or otherwise crimped or glued together with a strong adhesive to avoid any slippage of the tube along the first frame member 130, or any wobbling of the spring clip 112 relative the first frame member 130.

The second frame member 132 lies in substantially the same plane as the first frame member 130 and lies along a line that, if extended, would meet the spring clip 112 at about a 60 degree angle. Bridging the second frame member 132 and first frame member 130 is the third frame member 134. In more detail, both the first frame member 130 and second frame member 132 are straight tubular rods. The third frame member 134 is joined at its opposite ends to the proximal ends of the first frame member 130 and third frame member 134, and from the points of such joinders the first frame member 130 and second frame member 132 converge towards each other. As noted above and elsewhere, the first frame member 130 and second frame member 132 converge at a 60 degree angle. The third frame member 134 is essentially formed of bent rod instead of a curved rod.

The members of the framework 116 are sufficiently rigid rods. The degree of rigidity required is that necessary to maintain the 60 degree angle (which could be any where from a 50 to a 70 degree angle) alignment between the first frame member 130 and the second frame member 132 under conditions of normal use of the adjutant 110. Unlike the embodiment shown in FIG. 1 through FIG. 4, there is no fourth cross-bracing frame member included in the framework 116.

The slider arm 114 is a hollow tubular member which is slidably seated or journaled on the second frame member 132 below a spiral spring 140. The proximal-end first rim 142 of the slider arm 114 bears against the lower end of the spiral spring 140, while the upper end of the spiral spring 140 bears against the third frame member 134 about the point of the joint between the third frame member 134 and the second frame member 132. The spiral spring 140 is sized and coiled sufficiently to render the slider arm 114 spring-loaded, whereby the slider arm 114 is urged downward along the second frame member 132. The slider arm 114 has a jutting collar 129 providing a finger hold for pushing the slider arm 114 upward along the second frame member 132 against the bias of the spiral spring 140. The slider arm 114 thus rides up the second frame member 132 against the spring bias when pushed back, and down the second frame member 132 when released. The slider arm 114 upon release meets, at its tip, the clamp 112, and therefore under normal use conditions the slider arm 114 cannot ride so far down the second frame member 132 that it can slide off the second frame member 132.

The tip of the slider arm 114 is cut back on a 120 degree angle for the purposes discussed above regarding the embodiment shown in FIG. 1 to FIG. 4.

The adjutant 110 also optionally includes one or more flat finger buttons or finger holds 156, namely on opposite sides of the spring clip 112, at the connection between the first frame member 130 and third frame member 134, and/or at the connection between the second frame member 132 and third frame member 134. These finger holds 156 facilitate the operation of the adjutant 110, but are optional and not necessary to the operation of the adjutant 110. These finger holds 156 can be glued or soldered at the mounting points or mounted using conventional mechanical fasteners.

Figure 5A:
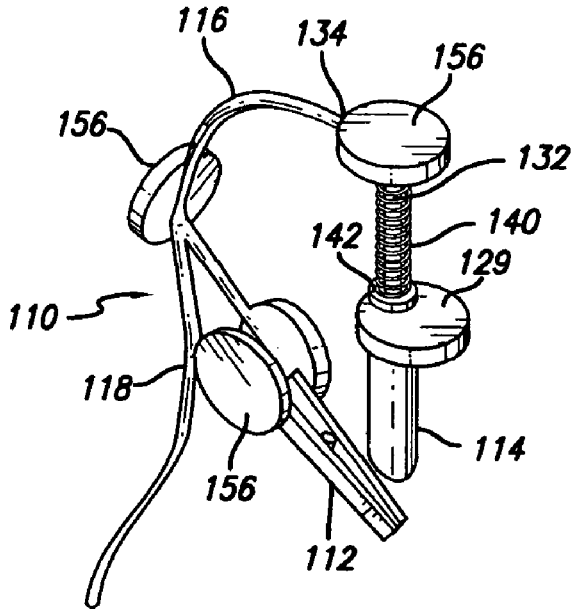
FIGS. 5*a* through 5*g* are a series of partially-diagrammatic perspective views of the active components of a bracelet attachment assistance device of the present invention, which series illustrates the method of the present invention.
Figure 5B:
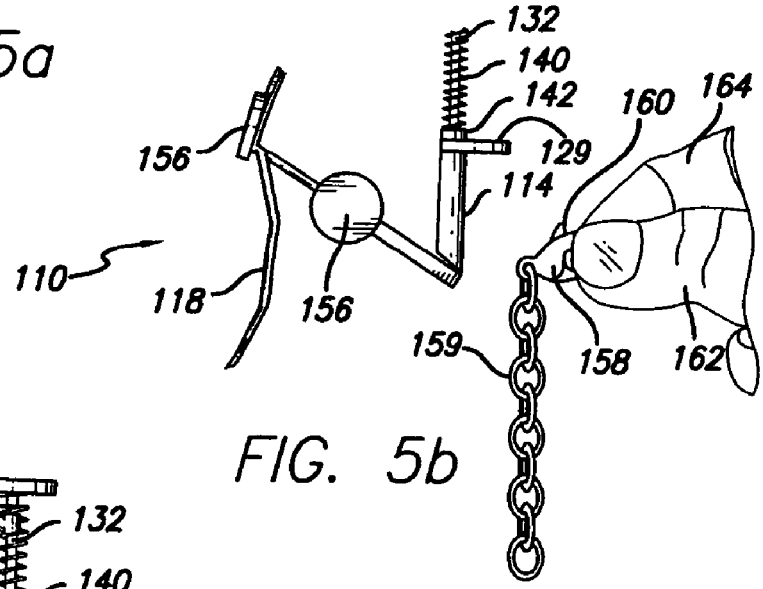
Figure 5C:
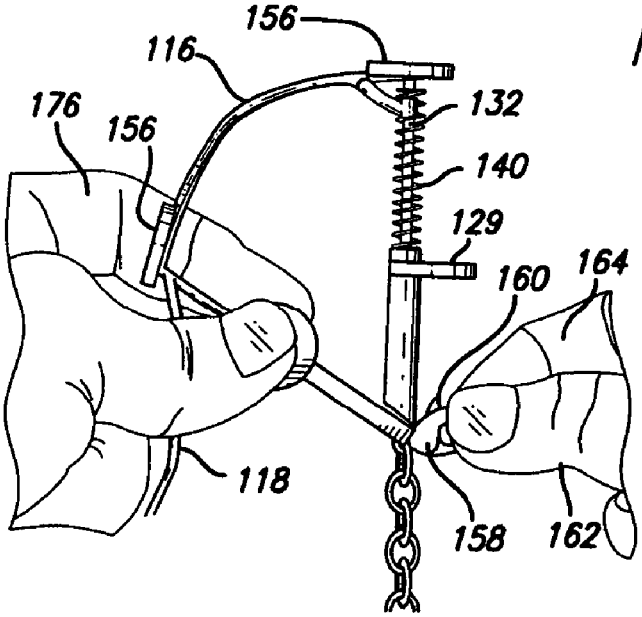
Figure 5D:
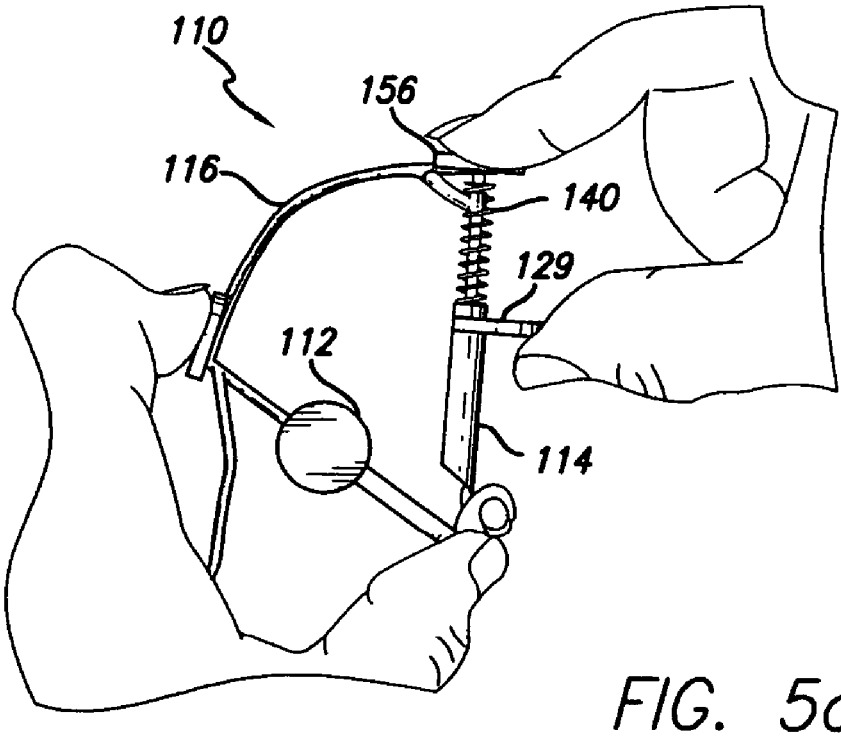
Figure 5E:
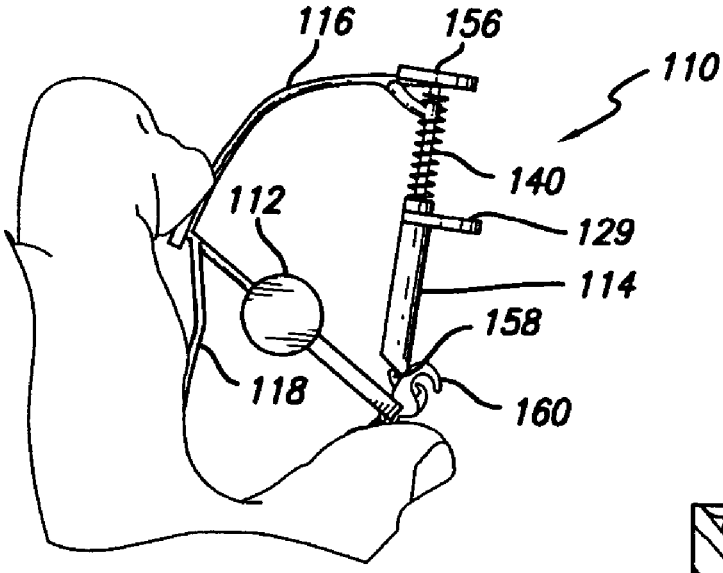
Figures 1, 5E:
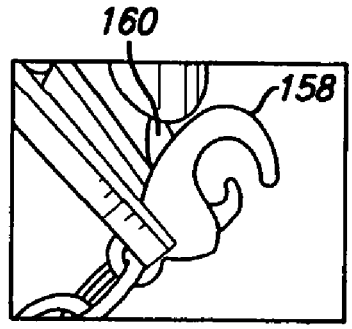

The use of the adjutant 10 of the present invention to assist putting a bracelet on one's own wrist by not only holding the spring ring of the clasp but also holding the spring ring in its open position, is both simple and quick. The illustrations of the steps of the method of the present invention are shown in FIG. 5*a* to FIG. 5*g*. In FIG. 5*a* there is shown the adjuvant 110 and its elements involved actively in the method, prior to the start of the method. First, while the adjuvant 110 is in its normally released or closed position, with the slider arm 114 released and abutting the alligator clip 112, pick up the spring ring 158 of a bracelet 159 with its tab 160 positioned outward and protruding upward. As shown particularly in FIG. 5*b*, this step is often most comfortably performed by holding the top or distal end 168 of the spring ring 158 between the thumb 162 and first finger 164 of the first or right hand 166, whereby the bottom or proximal end 170 of the spring ring 158 juts out from between the thumb 162 and first finger 164. Then while slightly opening the alligator clip 12, typically with the thumb 172 and first finger 174 of the second or left hand 176, the distal end 168 of the spring ring 158 is inserted into the tip of the alligator clip 112, as close to the connecting ring 178 of the bracelet 159 as practical, as shown in FIG. 5*b*. Also as seen in FIG. 5*b*, the slider arm 114 has not yet been raised, and therefore the tab 160 of the spring ring 158 will be seated close-by or abutting the side of the slider arm 114. In any event, the tab 160 of the spring ring 158 should not in any degree be within the grip of the alligator clip 112, and should be positioned above the clip 112. Then the spring ring 158 is gently pushed up or rotated up from below, generally using the thumb 172 left hand 176, as shown in FIG. 5*d*, while the first finger 174 of the left hand 176 is positioned on the opposite holder 156. The slider arm 112 is slightly withdrawn or drawn upward, generally using the thumb 162 of the right hand 166 on the tab 144 of the slider arm 114, with the first finger 164 of the first or right hand 166 on the opposed holder 156, and then allowed to move down to the point where it hooks the tab 160. By hooking the tab 160 is meant that the pointed tip of the slider arm 112 is positioned between the tab 160 of the spring ring 158 and the back of the spring ring 158. The slider arm 114 is then fully released, whereby it slides completed down the second frame member 32 and bears against the tab 160 of the spring ring 158 and the back of the spring ring 158, spreading them apart, pulling the spring ring 158 open and holding it open, as best seen in FIG. 5*e*, and the close-up view of 5*e*.1. In this step the tab 160 of the spring ring 158 is forced toward the clip 112 by the tip-end of the slider arm 114 while the body of the spring ring 158 is forced in the other direction, and the tab 160 might protrude into the slider arm 114.

Figure 5F:
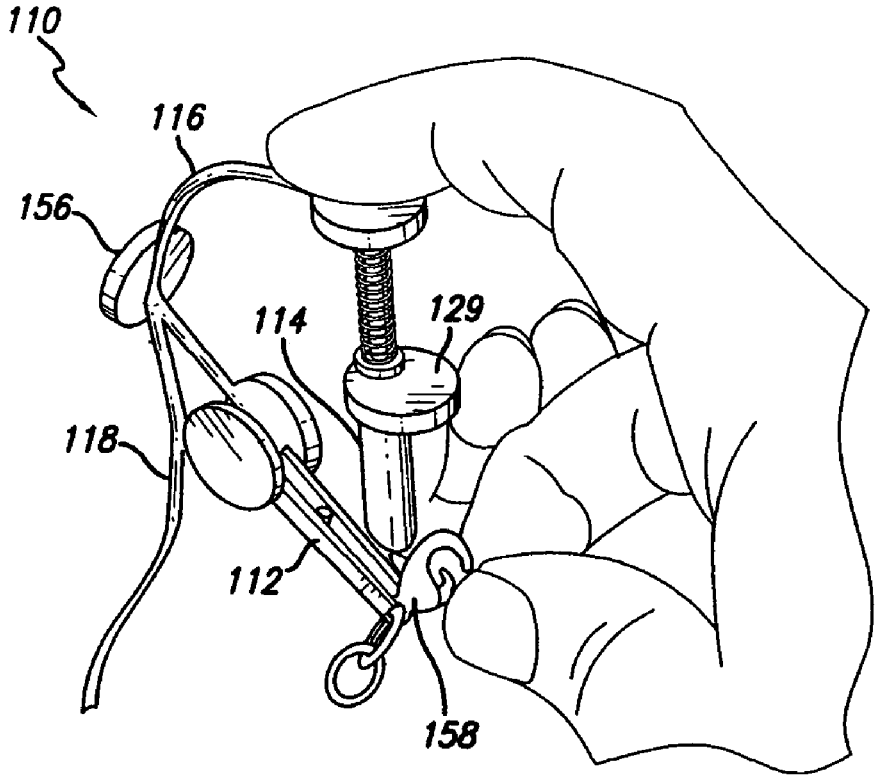
Figure 5G:
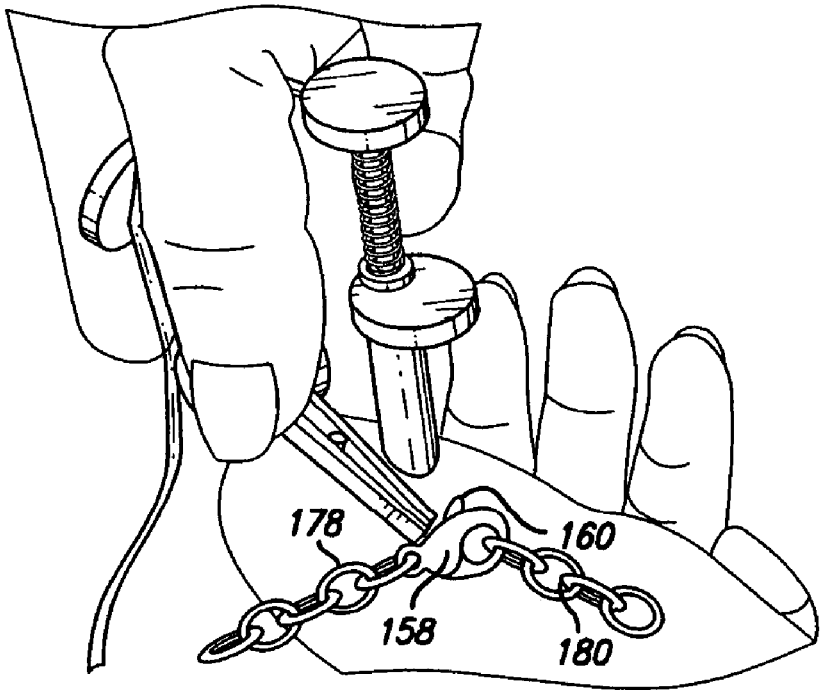

The user can, and obviously should, take her or his hands off of the adjuvant 110, and the adjuvant 110 will continue to hold the spring ring 158, and continue to hold the tab 160 of the spring ring 158 open. Then, as seen in FIG. 5*f*, the user merely places a wrist below the clip 112 of the adjuvant 110, pulls the opposite end of the bracelet 159 under and around the wrist, and inserts the clasp ring 180 of the bracelet 159 into the open spring ring 158. The clasp ring 180 of the bracelet 159 is generally inserted into the open spring ring 158 using the index finger and first finger 164 of the right hand 166. The adjuvant 110 may be steadied during this step between the first finger 164 of the right hand 166 placed on the top-most holder 156 and the wrist bearing gently upward. After the clasp ring 180 is inserted into the open spring ring 158, the slider arm 114 is raised at least somewhat and the clip 112 is opened somewhat to release the spring ring 158 and tab 160 of the spring ring 158, as best seen in FIG. 5*g*. As illustrated, the bracelet 159 was put on a person's left arm. If instead one wanted the bracelet on the right arm, the adjuvant 110 can merely be turned around with the tab 160 of the spring ring 158 being held open and the two ends of the bracelet 159 connected while reaching around the adjuvant 110 from behind. A left-handed person might, of course do the maneuvers illustrated for the right hand with his or her left hand without necessitating any structural modifications of the adjuvant 110 or its components. In any event, the user of an adjuvant has at least one free hand to insert the clasp ring of a bracelet into the open mouth of the spring ring of the bracelet.

In other words, the present invention is a bracelet attachment assistance device comprising: a frame member; a clamp member having a connection segment coupled to the frame member, a first jaw member, a second jaw member movable between an opened-clamp position and a closed-clamp position, and a clamping region along the first and second jaw members; and a slider arm member seated on the frame member, having a biased distal end, and movable between a closed position whereat the distal end is positioned adjacent the clamping region of the clamp member and an opened position whereat the distal end is positioned spaced apart from the clamping region of the clamp member. In preferred embodiments, the clamp member is retained at an angle of from about 50 to about 70 degrees to the slider arm. The clamp member is a normally-closed spring-loaded clip, and the connection segment is a segment of the first jaw member. The frame member is comprised of a first, a second and a third frame sections, wherein the third frame section coupled to first frame section and to the second from section, the clamp member coupled to the frame member at the first frame section, and the slider arm seated on the frame member at the second frame section. In further preferred embodiments, a cross brace is coupled to, bridging, the second frame section and the third frame section. In other preferred embodiments, the spiral ring and the slider arm member journaled on the second frame section forming in combination a spring-loaded slider arm assembly.

In other words, the present invention is a bracelet adjuvant comprising a frame, a spring-loaded clip, and a spring-loaded slider arm. The spring-loaded clip and the spring-loaded slider arm each have a free end, and the spring-loaded slider arm is movable from a normal released position, whereat its free end is disposed at the free end of the spring-loaded clip, to a withdrawn position, whereat its free end is disposed spaced apart from the free end of the spring-loaded clip, and the frame supports the spring-loaded clip and the spring-loaded slider arm. The frame is of a configuration that supports the spring-loaded clip and the spring-loaded slider arm at a angle of between about 50 and about 70 degrees. The frame in some preferred embodiments is of a configuration that supports the spring-loaded clip and the spring-loaded slider arm at a angle of about 60 degrees. The bracelet adjuvant of the present invention in preferred embodiments further includes a stand coupled to the frame and supporting the frame in an elevated position.

In other words, the present invention also includes a method of attaching a clasp-closure bracelet to the wrist of user employing a bracelet assistant. The bracelet has a jump ring end, a jump ring coupled to the jump ring end, a spring ring coupled to an end opposite the jump ring end. The spring ring has a tab and a distal end. The bracelet assistant has a frame, a clip, and a slider arm. The clip has a free end. The slider arm has a free end and a front side. The slider arm is movable from a normal released position, whereat the free end of the slider arm is disposed at the free end of the clip, to a withdrawn position, whereat the free end of the slider arm is disposed spaced apart from the free end of the clip. The frame supports the spring-loaded clip and the spring-loaded slider arm, and the user has a target hand and a non-target hand, each hand has a thumb and a finger, and a wrist adjacent the target hand. The method is comprised of the steps of: gripping the spring ring of the bracelet between the thumb and the finger of either the target hand or the non-target hand with the tab of the spring ring protruding upward between the thumb and the finger and with the proximal end of the spring ring jutting out from between the thumb and the finger; next, with the slider arm of the bracelet assistant in the normally released position, inserting the distal end of the spring ring into the clip and positioning the spring ring in the clip with the tab of the spring ring close to or abutting the forward side of the slider arm; next, raising the slider arm sufficiently to hook the tab of the spring ring; next, releasing the slider arm to bear against the tab of the spring ring, to open the spring ring, and to hold open the spring ring; next placing the wrist of the target hand below the clip; next, gripping the jump ring end of the bracelet with the non-target hand and drawing the jump-ring end of the bracelet under and around the wrist; next, inserting the jump ring into the open spring ring; and closing the spring ring.

The components of an adjuvant of the present invention may separately be formed of metallic or other material including, but not limited to, aluminum, steel, gold, other metals, plated metals, carbon fiber, fiberglass, or plastic, or any combination of these or other materials, provided each component is sufficiently rigid and durable to fulfill the role it plays in the method of use.

It is well within the skill of a person in the technical field, upon becoming conversant with, or otherwise having knowledge of, the present invention, to select suitable combinations of components, including without limitation the frame and the stand and the like, in view of the type of adjuvant being designed and/or constructed.

The above described embodiments are exemplitive, and the terminology is employed for illustration purposes and not limitation purposes. The present invention is not limited to the combinations and subcombinations illustrated herein.

I claim:

1. A bracelet attachment assistance device comprising:

a frame member;

a clamp member having a connection segment coupled to said frame member, a first jaw member, a second jaw member movable between an opened-clamp position and a closed-clamp position, and a clamping region along said first and second jaw members; and a slider arm member seated on said frame member, having a biased distal end, and movable between a closed position whereat said distal end is positioned adjacent said clamping region of said clamp member and an opened position whereat said distal end is positioned spaced apart from said clamping region of said clamp member.

2. The bracelet attachment assistant device of claim 1 wherein said clamp member is retained at an angle of from about 50 to about 70 degrees to said slider arm.

3. The bracelet attachment assistant device of claim 1 wherein said clamp member is a normally-closed spring-loaded clip, and wherein said connection segment is a segment of said first jaw member.

4. The bracelet attachment assistant device of claim 1 wherein said frame member is comprised of a first, a second and a third frame sections, said third frame section coupled to first frame section and to said second from section, said clamp member coupled to said frame member at said first frame section, and said slider arm seated on said frame member at said second frame section.

5. The bracelet attachment assistant device of claim 1 wherein said frame member is comprised of a first, a second, a third frame sections and a cross brace, said third frame section coupled to first frame section and to said second from section, said clamp member coupled to said frame member at said first frame section, said slider arm seated on said frame member at said second frame section, and said cross brace coupled to, and bridging, said second frame section and said third frame section.

6. The bracelet attachment assistant device of claim 1 further including a spiral spring, wherein said frame member is comprised of a first, a second and a third frame sections, said third frame section coupled to first frame section and to said second frame section, said clamp member coupled to said frame member at said first frame section, and said spiral ring and said slider arm member journaled on said second frame section forming in combination a spring-loaded slider arm assembly.

7. The bracelet attachment assistent device of claim 1 further including padding on said first and said second jaw members.

8. A bracelet adjuvant comprising a frame, a spring-loaded clip, and a spring-loaded slider arm, said spring-loaded clip having a free end, said spring-loaded slider arm having a free end, said spring-loaded slider arm being movable from a normal released position, whereat its free end is disposed at said free end of said spring-loaded clip to a withdrawn position, whereat its free end is disposed spaced apart from said free end of said spring-loaded clip, and said frame supporting said spring-loaded clip and said spring-loaded slider arm.

9. The bracelet adjuvant of claim 8 wherein said frame is of a configuration that supports said spring-loaded clip and said spring-loaded slider arm at a angle of between about 50 and about 70 degrees.

10. The bracelet adjuvant of claim 8 wherein said frame is of a configuration that supports said spring-loaded clip and said spring-loaded slider arm at a angle of about 60 degrees.

11. The bracelet adjuvant of claim 8 further including a stand coupled to said frame and supporting said frame in an elevated position.

12. The bracelet adjuvant of claim 8, said free end of said slider arm being formed as a biased tip.

13. The bracelet adjuvant of claim 8, said free end of said slider arm being formed as a hollow biased tip.

14. The bracelet adjuvant of claim 8, said free end of said slider arm being formed as a hollow, tubular biased tip.

15. The bracelet adjuvant of claim 8 wherein said clip has a first jaw and a second jaw, each of said first and said second jaws separately having a padded inner surface.

16. The bracelet adjuvant of claim 8 further including a stand coupled to said frame, said stand positioning said frame, said clip and said slider arm in elevated positions.

17. A method of attaching a clasp-closure bracelet to the wrist of user employing a bracelet assistant, said bracelet having a jump ring end, a jump ring coupled to said jump ring end, a spring ring coupled to an end opposite said jump ring end, said spring ring having a tab and a distal end, said bracelet assistant having a frame, a clip, and a slider arm, said clip having a free end, said slider arm having a free end and a front side, said slider arm being movable from a normal released position, whereat said free end of said slider arm is disposed at said free end of said clip, to a withdrawn position, whereat said free end of said slider arm is disposed spaced apart from said free end of said clip, said frame supporting said spring-loaded clip and said spring-loaded slider arm, and said user having a target hand and a non-target hand, each hand having a thumb and a finger, and a wrist adjacent said target hand, comprising the steps of:

gripping said spring ring of said bracelet between said thumb and said finger of either said target hand or said non-target hand with said tab of said spring ring protruding upward between said thumb and said finger and with said proximal end of said spring ring jutting out from between said thumb and said finger;

next, with said slider arm of said bracelet assistant in said normally released position, inserting said distal end of said spring ring into said clip and positioning said spring ring in said clip with said tab of said spring ring close to or abutting said forward side of said slider arm;

next, raising said slider arm sufficiently to hook said tab of said spring ring;

next, releasing said slider arm to bear against said tab of said spring ring, to open said spring ring, and to hold open said spring ring;

next placing said wrist of said target hand below said clip;

next, gripping said jump ring end of said bracelet with said non-target hand and drawing said jump-ring end of said bracelet under and around said wrist;

next, inserting said jump ring into said open spring ring; and closing said spring ring.

* * * * *